US007448689B2

(12) United States Patent
Carter et al.

(10) Patent No.: US 7,448,689 B2
(45) Date of Patent: Nov. 11, 2008

(54) MODULAR FURNITURE ATTACHMENT STRAP

(75) Inventors: Howard S. Carter, Chattanooga, TN (US); Cynthia D. Rollins, Oakdale, TN (US); Thomas M. Swafford, Dayton, TN (US); Andrew C. Resovsky, Ypsilanti, MI (US); Mark D. Bullock, Hixson, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 177 days.

(21) Appl. No.: 11/374,617

(22) Filed: Mar. 13, 2006

(65) Prior Publication Data

US 2006/0220435 A1 Oct. 5, 2006

Related U.S. Application Data

(60) Provisional application No. 60/667,934, filed on Apr. 4, 2005.

(51) Int. Cl.
*A44B 18/00* (2006.01)

(52) U.S. Cl. ..... 297/440.14; 297/248; 24/442

(58) Field of Classification Search ..... 297/248, 297/249, 440.1, 440.14, 440.15; 24/306, 24/442

See application file for complete search history.

(56) References Cited

U.S. PATENT DOCUMENTS 3,093,410 A 6/1963 Wilson
3,162,484 A 12/1964 Kleffman
3,383,738 A 5/1968 Fox et al.
3,631,568 A 1/1972 Wolf
3,640,569 A 2/1972 Young
3,807,801 A 4/1974 Dalsgard
3,841,701 A 10/1974 Sullivan
3,944,281 A 3/1976 Piretti
3,973,800 A 8/1976 Kogan
4,077,666 A 3/1978 Heumann
4,081,199 A 3/1978 Blodee
4,179,158 A * 12/1979 Flaum et al. ..... 297/440.17
4,278,288 A 7/1981 Thebaud
4,296,558 A * 10/1981 Antonious ..... 36/50.1
4,456,299 A 6/1984 Steinmetz
4,497,524 A 2/1985 Levings, Jr. et al.
4,518,203 A 5/1985 White
4,541,150 A 9/1985 Brokmann
4,668,011 A 5/1987 Fister, Jr.
4,848,839 A 7/1989 Galardo
4,864,794 A 9/1989 Scourtelis
4,945,587 A 8/1990 Ferro
5,038,421 A 8/1991 Harris
5,101,811 A 4/1992 Brunswick (Continued)

*Primary Examiner*—Patrick D Lynch
(74) *Attorney, Agent, or Firm*—Harness, Dickey & Pierce, P.L.C.

(57) ABSTRACT

A furniture member strap system includes a first strap having loop members at a first end and hook members at a second end and a first sewn area positioned between the loop members and the hook members. A second strap has opposed ends overlapping each other creating a looped end. A buckle member has an elongated aperture to receive the looped end. A strap assembly has the second end of the first strap slid through the aperture of the buckle member and the hook members releasably engaged with the loop members. The assembly joins first and second members of a furniture assembly having the first and second straps sewn to the first and second furniture members.

16 Claims, 8 Drawing Sheets

U.S. PATENT DOCUMENTS 5,123,705 A * 6/1992 Johnson ..... 297/423.4
5,218,742 A * 6/1993 Sleven ..... 24/30.5 R
5,234,253 A 8/1993 LaPointe et al.
5,314,234 A 5/1994 England
5,322,257 A 6/1994 Verderose et al.
5,352,017 A 10/1994 Berning
5,395,156 A 3/1995 Friedman
5,487,246 A 1/1996 Hodges et al.
5,513,450 A * 5/1996 Aviles Palazzo ..... 36/128
5,566,409 A * 10/1996 Klearman ..... 5/723
5,604,961 A * 2/1997 Cole ..... 24/306
5,630,644 A 5/1997 LaPointe et al.
5,836,655 A 11/1998 Laufer
5,839,803 A 11/1998 Lizell
6,449,815 B1 * 9/2002 Spiller ..... 24/306
6,702,391 B1 3/2004 Stipek
6,722,742 B2 4/2004 Potes et al.
6,783,182 B1 8/2004 Gallagher
6,824,220 B1 * 11/2004 Davison ..... 297/440.14
6,877,824 B2 4/2005 Winkless
7,104,864 B1 * 9/2006 Liou ..... 446/221
2002/0195848 A1 12/2002 Seitz et al.

* cited by examiner

A
B
10
12
14
16
18
20
22
24
26
28
30
32
34
36
38
40
42
44
46
48

FIG 7
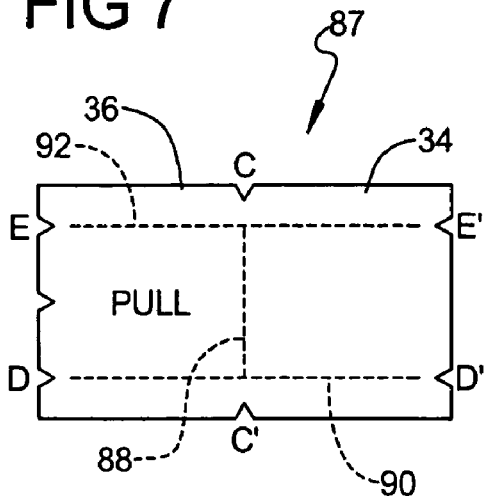
FIG 8
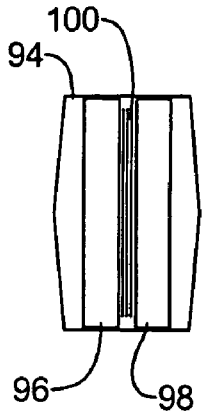
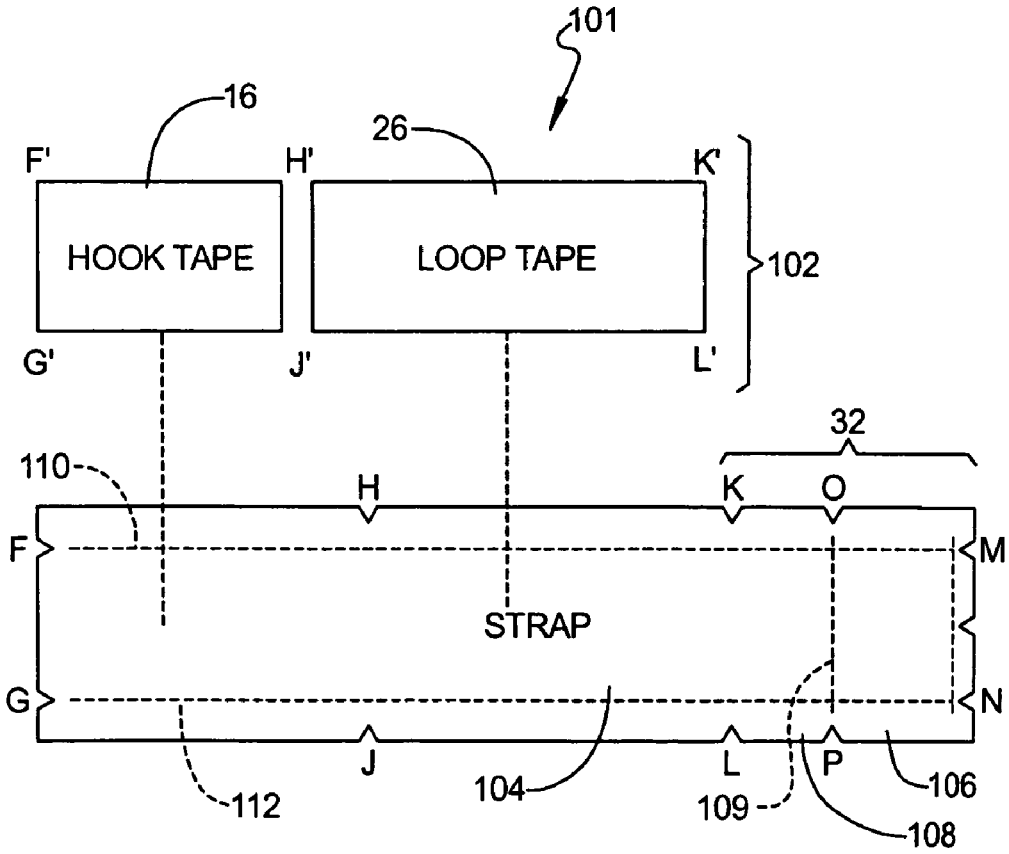
FIG 9

MODULAR FURNITURE ATTACHMENT STRAP

CROSS-REFERENCE TO RELATED APPLICATIONS

This application claims the benefit of U.S. Provisional Application No. 60/667,934, filed on Apr. 4, 2005. The disclosure of the above application is incorporated herein by reference.

FIELD

The present disclosure relates in general to multiple piece sectional or modular furniture and more specifically to a device and method for connecting pieces of modular furniture.

BACKGROUND

Modular furniture systems which include sectional piece sofas, loveseats, combination sofas and reclining chairs, and bedding units, etc., have multiple pieces or sections which are positioned abutting each other but are repositionable so the same unit can be positioned in multiple locations or in multiple configurations. When sections are butted together with no additional mechanical coupling device(s), the individual sections can separate from each other which is undesirable.

To overcome the problems associated with simple butted joints of modular furniture, manufacturers have developed mechanical connections or joints to positively couple individual sections of a modular furniture system. These mechanical connections include male extending members connected to a first unit which are matably received in female receiving slots or openings of the second unit. The individual units can also be fastenably connected together using bolts and nuts or screws. More complex mechanical connections include the use of sliding joints, metallic hooks, and flanges or brackets.

The drawbacks of known mechanical connections for these applications include difficulty in initially aligning a first furniture member with a second furniture member to ensure that the mechanical connections join properly. Additionally, when the furniture sections are separated from each other, male extending members from one of the units present an unacceptable visual appearance and therefore must be removed if the end face of the furniture unit having the male members is to be a finished end of the new furniture configuration. Further drawbacks for fastener attached furniture members include realignment problems when the units are re-assembled. Apertures through which the fasteners connect the furniture members must be realigned properly, and if different furniture sections have apertures which are out of alignment with each other, the new configuration is difficult to assemble.

SUMMARY

According to several embodiments a modular furniture attachment strap of the present disclosure includes a first strap having a plurality of loop members at a first end and a plurality of hook members at a second end and a first sewn area positioned between the loop members and the hook members. A second strap includes opposed ends overlapping each other which define a looped end. A buckle member includes an elongated aperture to receive the looped end. A strap assembly is created having the second end of the first strap slid through the elongated aperture of the buckle member and having the hook members releasably engaged with the loop members. The assembly is operable to join first and second members of a furniture assembly having the first strap sewn to the first member and the second strap sewn to the second member.

According to several embodiments, a furniture member strap connection system includes a first strap having a plurality of loop members at a first end and a plurality of hook members at a second end and a first sewn area positioned between the loop members and the hook members. A second strap has opposed ends overlapping each other defining a looped end. A buckle member has an elongated aperture operable to receive the looped end. A first furniture member has the first strap sewn to the first furniture member at the first sewn area. A second furniture member has the second strap sewn to the second furniture member. A first strap assembly includes the second end of the first strap slidably disposed through the elongated aperture of the buckle member and the hook members releasably engaged with the loop members. The first strap assembly is operable to releasably join the first and second furniture members.

According to still other embodiments, a method for connecting furniture members using a strap is provided. The method includes a step of sewing the first strap to a first furniture member at the first sewn area. The method also includes a step of sewing the second strap to a second furniture member. The method further includes a step of slidably disposing the second end of the first strap through the elongated aperture of the buckle member. The method still further includes a step of releasably engaging the plurality of hook members with the plurality of loop members to releasably join the first and second furniture members.

Modular furniture attachment straps of the present disclosure offer several advantages. By using generally flat strap material releasably joined using hook and loop connections, the attachment straps can be positioned beneath cushions or upholstery coverings so they are not visible when in use. The hook and loop attachment connections of the present disclosure provide a simplified alignment and releasable joining system for modular furniture sections. Alignment of individual sections does not require visual alignment of extending fasteners, potential damage to other sections, other furniture or walls from male extending mechanical connectors. Use of reverse configured straps of the present disclosure also allows any section of furniture to be connected to any other section without the use of threaded fasteners, the loss of fastener members and/or the addition of fasteners.

Further areas of applicability of the present disclosure will become apparent from the detailed description provided hereinafter. It should be understood that the detailed description and specific examples, while indicating several embodiments of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein:

FIG. 7 is a plan view of a pull section of an alternate embodiment of the present disclosure;

FIG. 8 is a plan view of a buckle according to another embodiment of the present disclosure;

FIG. 9 is a plan view of a hook and loop tape assembly with a strap of the present disclosure;

DETAILED DESCRIPTION

The following description of several embodiments is merely exemplary in nature and is in no way intended to limit the disclosure, its application, or uses.

Figures 1, 2:
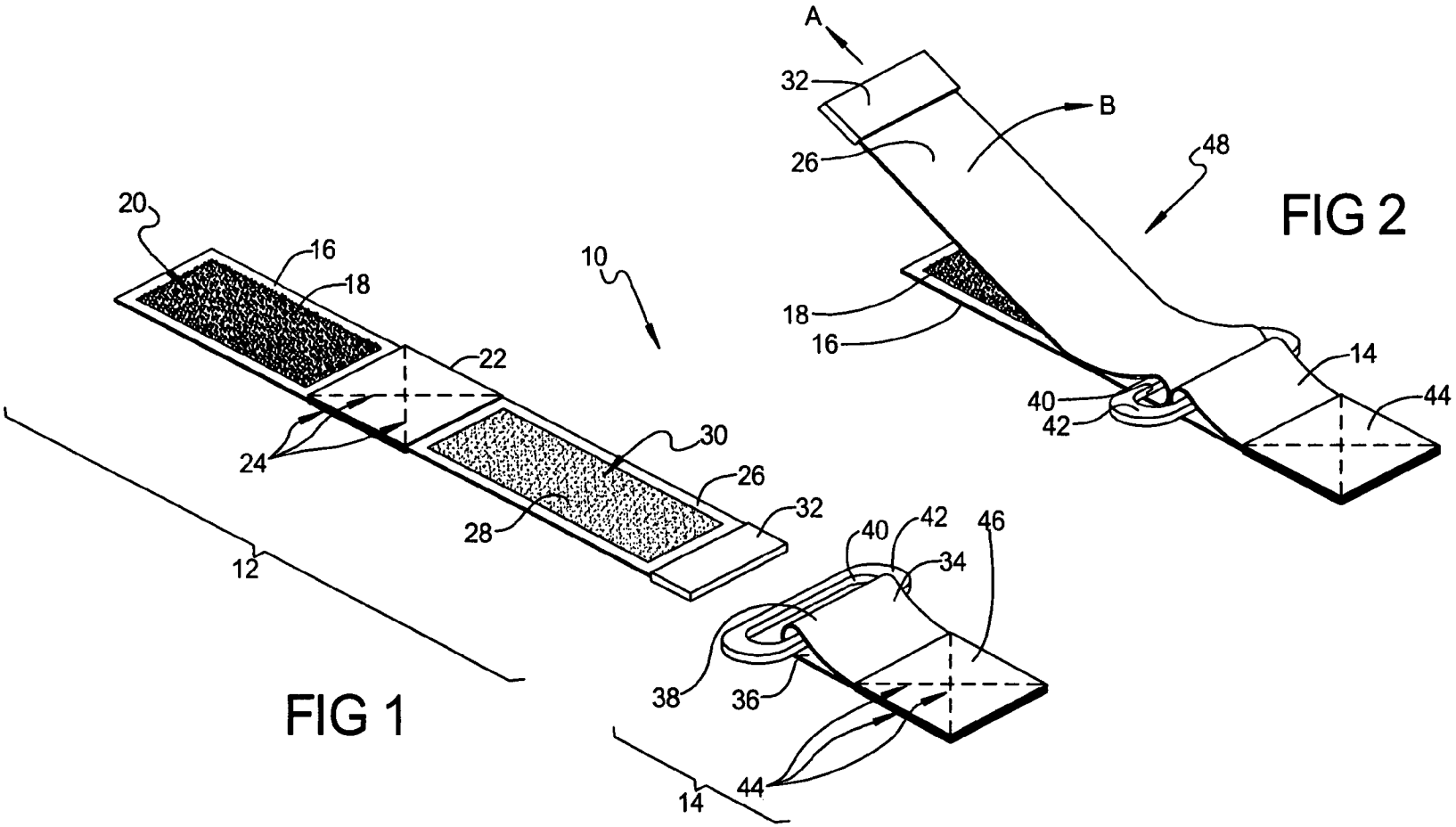
FIG. 1 is a perspective view of a modular furniture attachment strap according to several embodiments of the present disclosure.
FIG. 2 is a perspective view of the modular furniture attachment strap of FIG. 1 further shown in an assembled state.

According to several embodiments of a modular furniture attachment strap of the present disclosure and referring generally to FIG. 1, an attachment strap system 10 includes a pull or first strap member 12 and a second strap member 14. First strap member 12 includes a first portion 16 having a female connecting region 18 providing a plurality of loop members 20. First strap member 12 further includes a sewn area 22 which is adapted for receiving a plurality of sewn seems 24. A second portion 26 of first strap member 12 provides a male connecting region 28 having a plurality of male hook members 30. Male hook members 30 are releasably engageable when contacting loop members 20 of first portion 16 to form a plurality of hook and loop connections. A pull tab 32 is provided at a distal end of second portion 26 oppositely positioned from first portion 16. In several embodiments, pull tab 32 is created by doubling a thickness of (for example by folding over) an end of second portion 26. In another embodiment, pull tab 32 is a polymeric material and is separately connected to the end of second portion 26.

Second strap member 14 includes each of a first section 34 and a second section 36 which are folded over each other to form a looped end 38 which passes through an elongated aperture 40 of a buckle member 42. First and second sections 34, 36 are made of the same material as first strap member 12. Buckle member 42 is preferably made of a polymeric material, however both buckle member 42 and pull tab 32 (if separately provided) can also be made of metal or composite materials. After forming looped end 38 through elongated aperture 40, distal ends of each of first and second sections 34, 36 are joined using a plurality of sewn seams 44 to create an "X" or crisscross pattern for a sewn area 46. Sewn area 46 can be created independently as shown or can be created when second strap member 14 is attached to a furniture member.

As best seen in reference to FIG. 2, a strap assembly 48 is created by passing pull tab 32 through elongated aperture 40 of buckle member 42 and pulling on pull tab 32 in a tightening direction "A". The plurality of hook members 30 of second portion 26 are then engaged with the plurality of loop members 20 of female connecting region 18 of first portion 16. The plurality of hook and loop connections which are formed thereby resist removal of second portion 26 through elongated aperture 40 and maintain a releasable connection for strap assembly 48. Strap assembly 48 can be disassembled by pulling pull tab 32 in a removal direction "B" which releases the plurality of hook members 30 from engagement with the plurality of loop members 20. Second portion 26 and pull tab 32 are then pulled in a reverse direction from formation through elongated aperture 40 to completely release second strap member 14 from first strap member 12.

In several embodiments of the present disclosure, first strap member 12 is made using a polymeric or woven cloth material approximately 2 inches wide (5.1 cm) having for male connecting region 28 tape such as UltraMate® hook tape type 706 made by Velcro USA Inc. The female connecting region 18 or loop portion can also be an UltraMate® material. First strap member 12 is joined such as by cladding, adhesive, sewing, or bonding. Second strap member 14 has a similar base material as first strap member 12. When pull tab 32 is separately provided (not provided as doubled over material of second portion 26) pull tab 32 is preferably a polymeric material such as nylon. For this embodiment, pull tab 32 can be attached to first strap member 12 using an adhesive, by thermal bonding, or by mechanical attachment devices such as staples, etc. Pull tab 32 can also include a hollow cavity (not shown) which receives a portion of second portion 26 prior to attachment. In one embodiment, thread used for sewn seems 24 and 44 can be Nymo EX Knotless EL, of a bonded nylon material. The disclosure is not limited to the above noted materials or sources.

Figure 3:
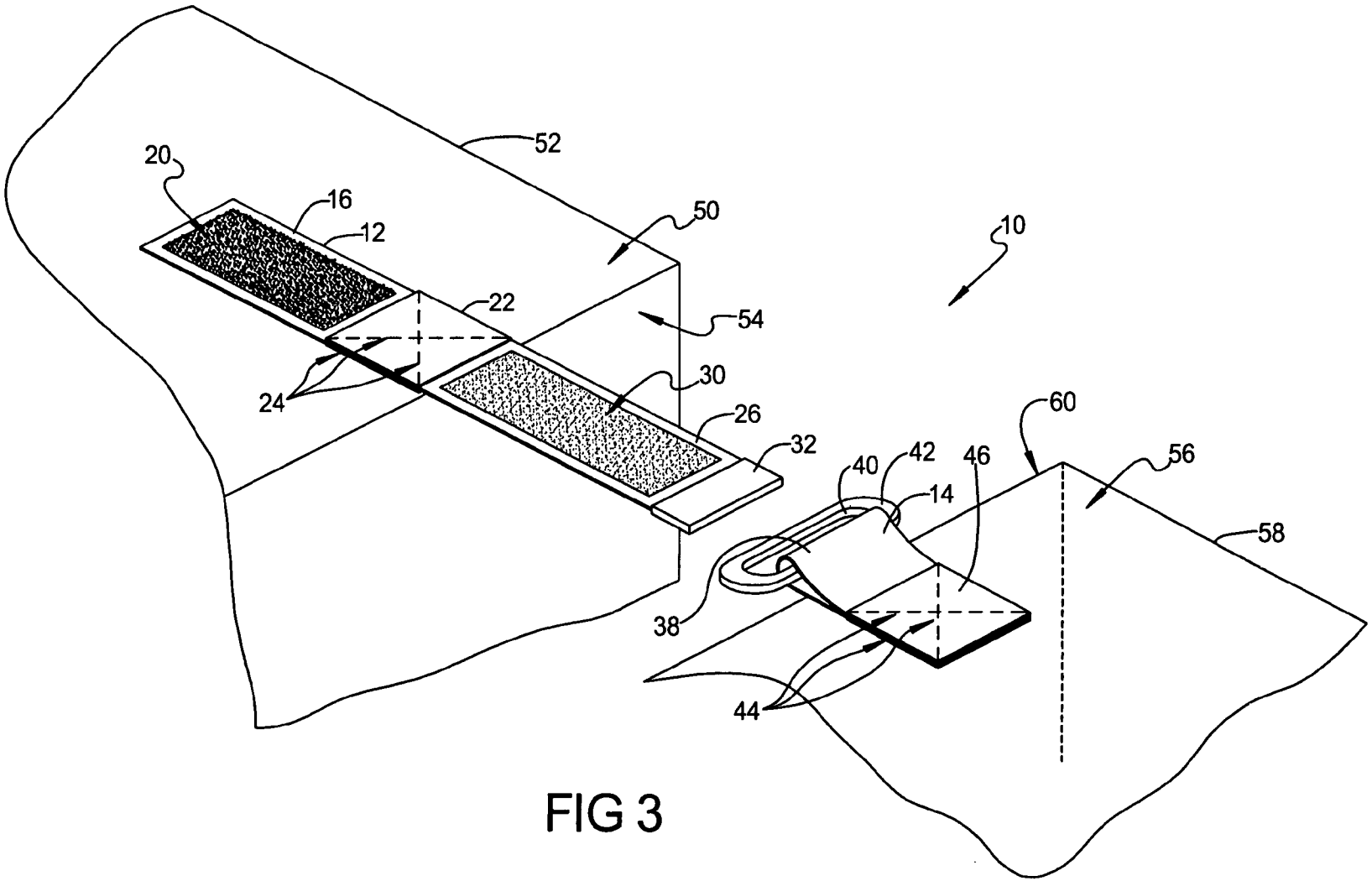
FIG. 3 is a perspective view of the strap members of FIG. 1 connected to individual furniture members in an exemplary configuration.

As best seen in reference to FIG. 3, attachment strap system 10 can be used to releasably join individual furniture members. In the example shown, first strap member 12 is connected to a connection surface 50 of a first furniture member 52. The plurality of sewn seams 24 is used to connect sewn area 22 to connection surface 50. Loop members 20 are exposed facing upward as viewed in FIG. 3 and away from connection surface 50. Second portion 26 distally extends past a first joining surface 54 of first furniture member 52. In a similar manner, the plurality of sewn seams 44 which join first and second sections 34, 36 are also used to connectively join sewn area 46 to a connection surface 56 of a second furniture member 58. When sewn seams 44 are completed, looped end 38 and buckle member 42 freely extend from connection surface 56 and can optionally extend beyond a second joining surface 60 of second furniture member 58.

Figure 4:
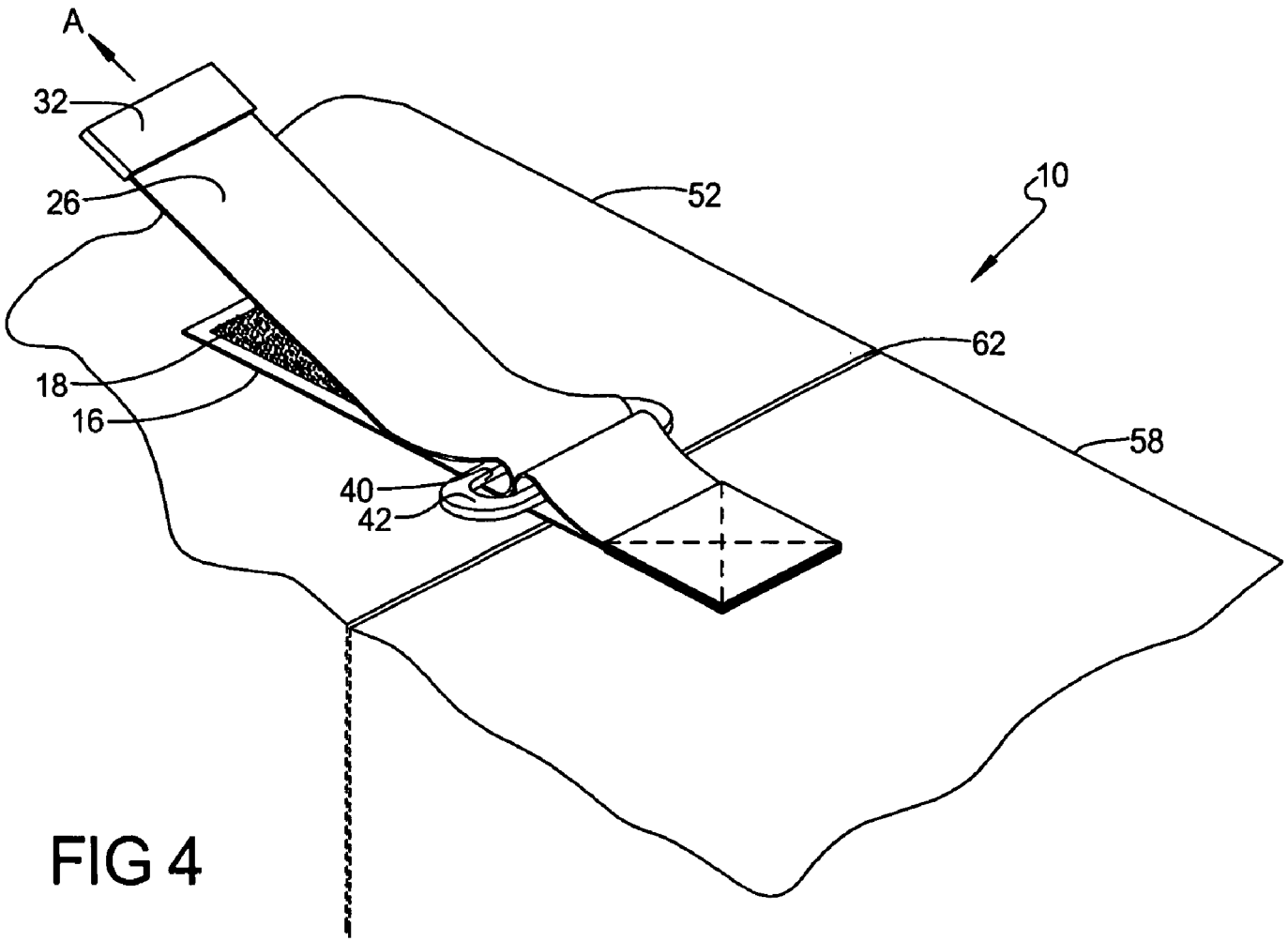
FIG. 4 is a perspective view similar to FIG. 3, further showing the assembled condition of the strap and furniture members.

Referring now to FIG. 4, following the operations described in reference to FIG. 3, pull tab 32 is inserted through elongated aperture 40 of buckle member 42 and pulled in the tightening direction "A". When first joining surface 54 of first furniture member 52 generally abuts second joining surface 60 of second furniture member 58, an abutting joint 62 is created. Following creation of abutting joint 62, hook members 30 of second portion 26 are engaged with the plurality of loop members 20 of female connecting region 18 of first portion 16. First furniture member 52 is thereby releasably connected to second furniture member 58 using attachment strap system 10.

Figure 5:
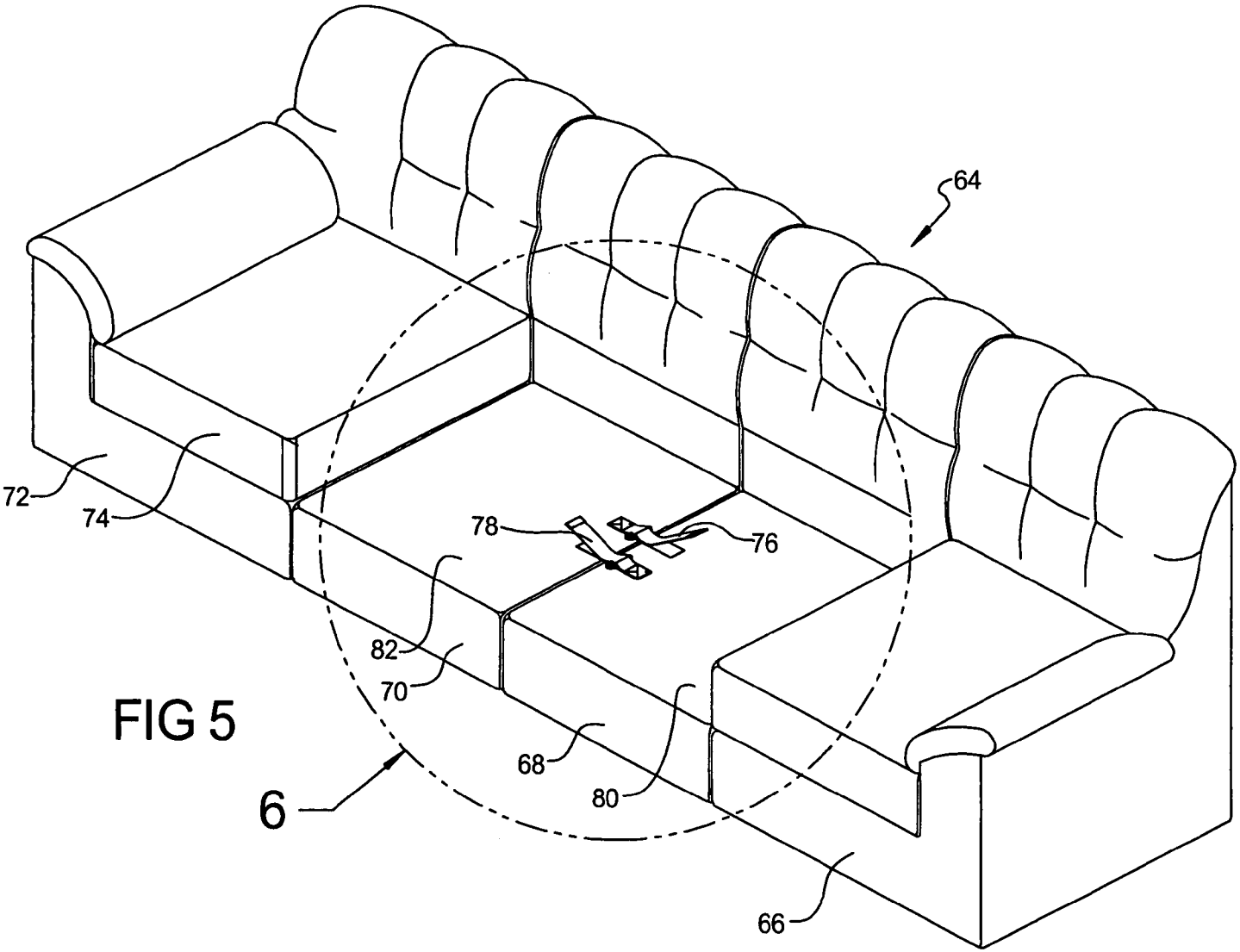
FIG. 5 is a perspective view of a modular sofa unit having individual sections connected using multiple modular furniture attachment straps of FIG. 1.

Referring now to FIG. 5, a sectional sofa 64 is joined using multiple straps of the attachment strap system 10 of the present disclosure. Sectional sofa 64 includes a first end section 66, a first interchangeable section 68, a second interchangeable section 70 and a second end section 72. Each of the first end section 66, first interchangeable section 68, second interchangeable section 70 and second end section 72 are provided with at least one cushion 74. Cushions 74 are removed from each of first and second interchangeable sections 68 and 70 for clarity. A first strap assembly 76 and a second strap assembly 78 are shown joining first interchangeable section 68 to second interchangeable section 70. The remaining items of sectional sofa 64 are each joined in a similar manner. First and second strap assemblies 76, 78 have their individual members sewn to each of a seating support area 80 or a seating support area 82 of first or second interchangeable section 68, 70 respectively. By connecting first and second strap assemblies 76, 78 to seating support areas 80, 82 respectively, the strap assemblies are not visible after placement of the cushions 74.

Figure 6:
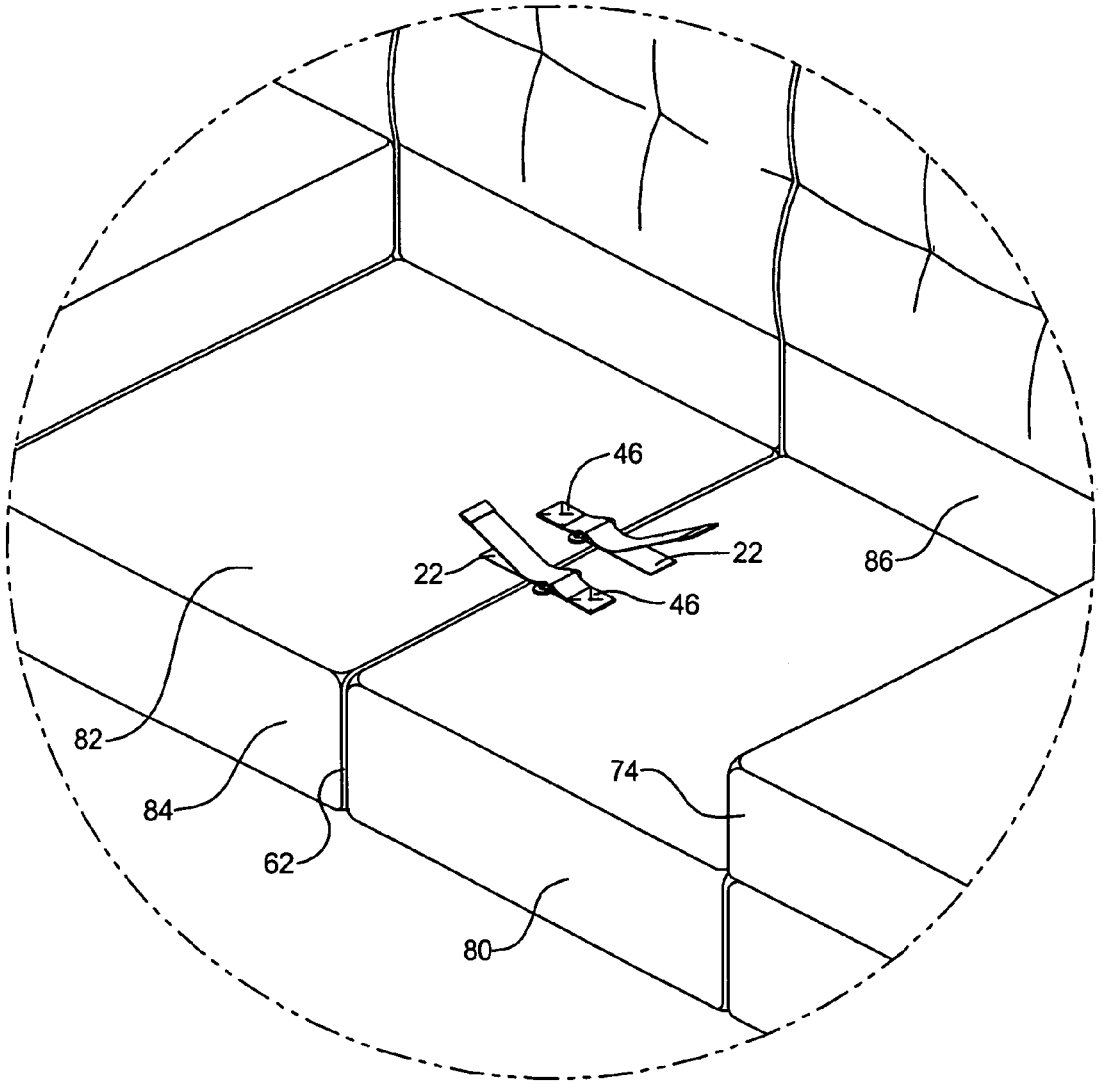
FIG. 6 is a partial perspective view taken at area 6 of FIG. 5.

Referring now to FIG. 6, sewn area 46 of first strap assembly 76 is connectively sewn to seating support area 80 of first interchangeable section 68. Sewn area 22 of first strap assembly 76 is sewn to seating support area 82 of second interchangeable section 70. In reverse configuration, sewn area 22 of second strap assembly 78 is sewn to seating support area 80 and sewn area 46 of second strap assembly 78 is sewn to seating support area 82. This reverse configuration of strap assemblies ensures that interchangeable sections of any sectional furniture member can be joined to any other sectional member using at least one of the strap assemblies. It is desirable but not limiting to the disclosure that the attachment strap system 10 of the present disclosure be configured with the strap assemblies positioned in areas which are not visible once cushions or similar items are positioned. Other exemplary locations for strap assemblies of the present disclosure include forward facial area 84 and/or lumbar support area 86. Forward facial area 84 can be used if additional covering or upholstery is subsequently added to hide the attachment straps or if visibility of the straps is acceptable. Lumbar support area 86 is advantageous because the cushions 74 will subsequently be positioned over and thereby prevent visibility of the attachment straps. Attachment straps of the present disclosure can also be mounted to back-side surfaces of furniture members which are also subsequently out of sight after assembly or positioning of the units.

Referring more specifically to FIG. 7, an alternate method for creating a second strap assembly 87 includes inserting second strap member 14 through elongated aperture 40 of buckle member 42 (or through one of elongated apertures 96 or 98 of buckle member 94) and folding second strap member 14 substantially in half along a fold line 88 positioned between notches C and C'. Once folded, seams are sewn along a seam line 90 from notches D,D' towards fold line 88, and along a seam line 92 from notches E,E' towards fold line 88. Seam lines 90 and 92 are used in place of the crossing pattern of sewn seams 44.

Referring now to FIG. 8, in an alternate embodiment a double aperture buckle member 94 includes a first elongated aperture 96 and a second elongated aperture 98. Each of elongated apertures 96 and 98 receive opposite ones of either first or second strap members 12 or 14. A ridged area 100 provides a visual reference for subsequent use in correctly aligning buckle member 94. Buckle member 94 can be used in place of buckle member 42.

Referring next to FIG. 9, a method to create a strap assembly 101 includes sewing first portion 16 to second portion 26 at a junction H',J' to create a tape assembly 102. The second portion 26 end of tape assembly 102 is then sewn between points K' and L' to a strap 104 between corresponding locating notches K and L. Pull tab 32 is then created by folding a first section 106 over a second section 108 along a fold line 109 created between notches O and P. To complete strap assembly 101, tape assembly 102 is completely sewn to strap 104 along first and second longitudinal seams 110,112 which also extend through first and second sections 106,108 to complete pull tab 32.

Figure 10:
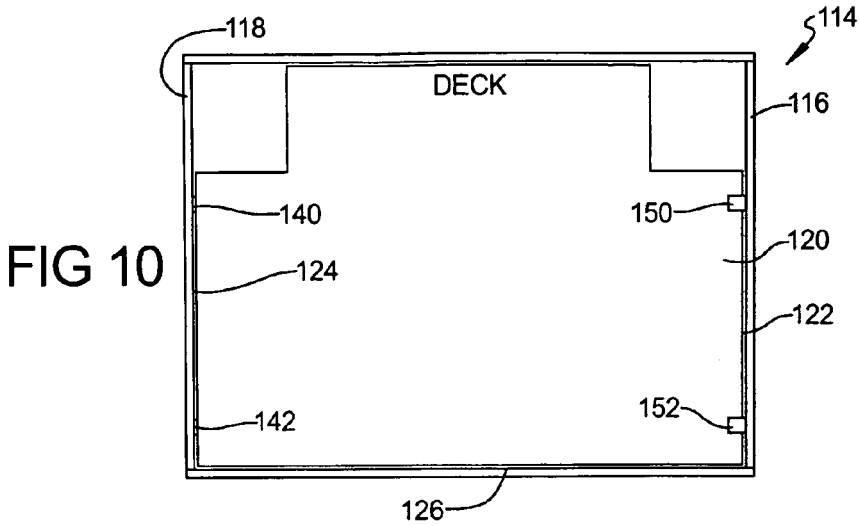
FIG. 10 is a plan view of an interchangeable furniture section having opposed pairs of each of a buckle assembly and a strap assembly.
Figure 11:
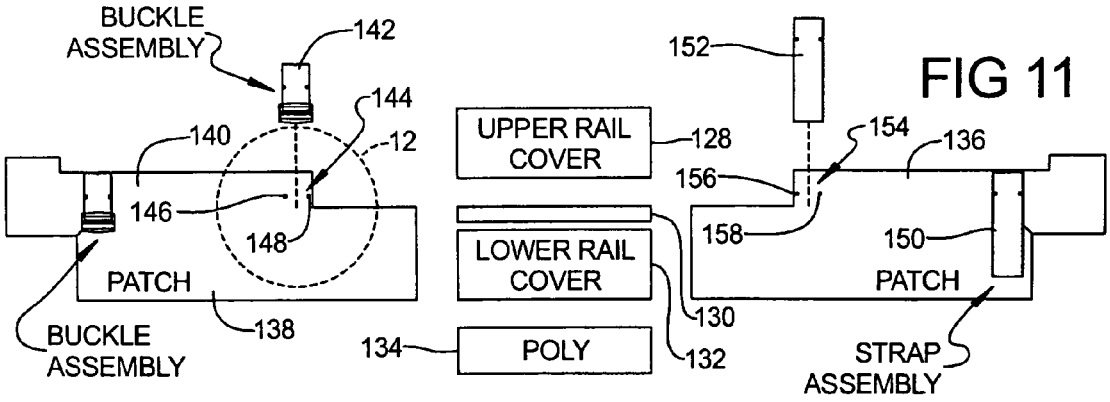
FIG. 11 is a plan view of the front rail cover members and side rail patches of the present disclosure.
Figure 12:
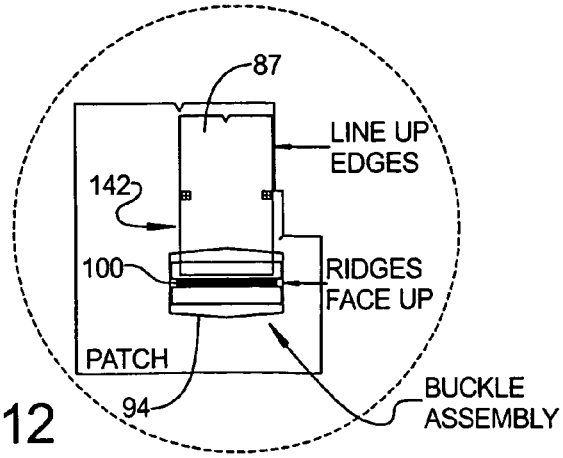
FIG. 12 is an enlarged partial plan view of area 12 of FIG. 11.

Referring now to FIGS. 10-12, in another embodiment of the present disclosure, an interchangeable furniture section 114 includes first and second side frames 116, 118 and a deck covering 120. A junction 122 is created between first side frame 116 and deck covering 120. A junction 124 is created between second side frame 118 and deck covering 120. Interchangeable furniture section 114 also includes a front rail 126 which is covered with material such as an upper rail cover 128, a bead cover 130 and a lower rail cover 132. A polymeric layer 134 is positioned between front rail 126 and lower rail cover 132.

First and second material patches 136 and 138 are provided to each support either a pair of buckle assemblies or a pair of strap assemblies. Material patches 136 and 138 provide additional strength to the sewn connections and distribute the load of the connected strap and buckle assemblies. In the example shown, first and second buckle assemblies 140, 142 each include a second strap member 87 and a buckle member 94. First and second buckle assemblies 140, 142 are connected to second material patch 138 which is connected to second side frame 118 and positioned proximate to junction 124 between second side frame 118 and deck covering 120. First buckle assembly 140 is shown in its final connected position to second material patch 138. Second buckle assembly 142 is shown in FIG. 11 prior to installation in an area 144 of second material patch 138. A pair of first and second apertures 146, 148 are pre-located in second material patch 138 and are used to visually line up second buckle assembly 142 for sewing or attachment. Similar apertures (shown in phantom) are also used to visually line up first buckle assembly 140.

First and second strap assemblies 150, 152 are connected to first side frame 116 and positioned proximate to junction 122 between first side frame 116 and deck covering 120. First and second strap assemblies 150, 152 are each similar to strap assembly 101, having a first portion 16, a second portion 26 and a pull tab 32.

First strap assembly 150 is shown in its final connected position on first material patch 136. Second strap assembly 152 is shown in FIG. 11 prior to installation in an area 154 of first material patch 136. Third and fourth apertures 156, 158 (similar to first and second apertures 146,148) are pre-located on first material patch 136 and are used to visually line up second strap assembly 152 for sewing or attachment. Similar apertures (shown in phantom) are also used to visually line up first strap assembly 150.

Figure 13:
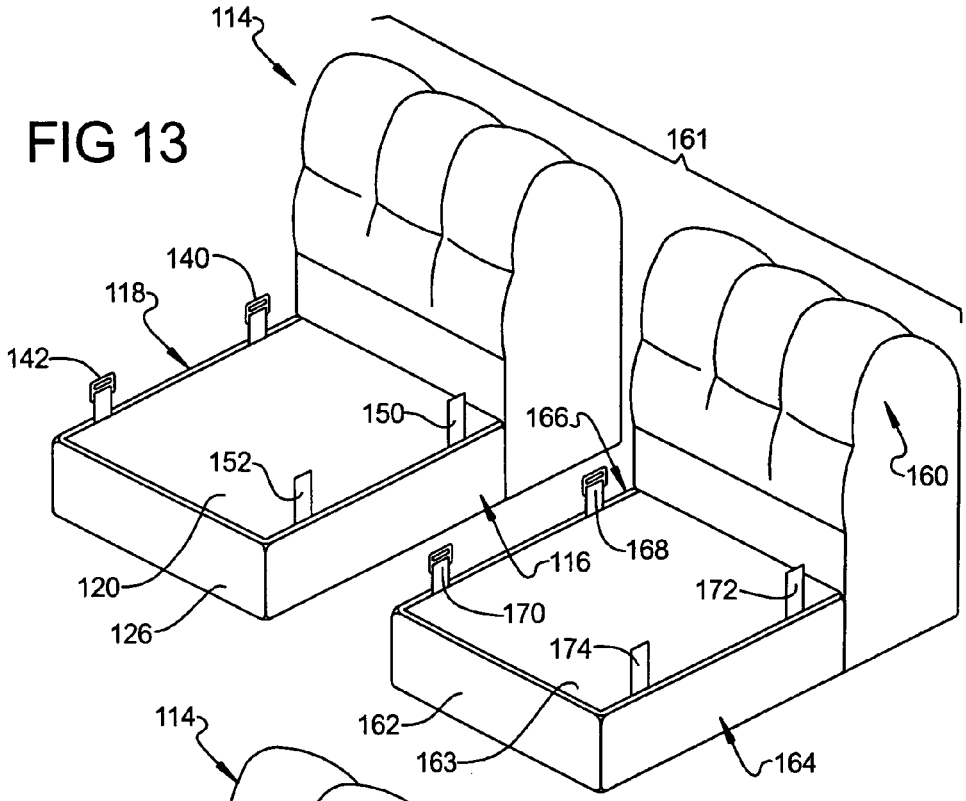
FIG. 13 is a front perspective view of two interchangeable furniture sections having attachment straps of the present disclosure.

Referring next to FIG. 13, interchangeable furniture section 114 is shown prior to joining to an interchangeable furniture section 160 to create a furniture unit 161. First and second strap assemblies 150 and 152 form a first pair of strap assemblies connected to an interior face of first side frame 116. First and second buckle assemblies 140, 142 form a first pair of buckle assemblies connected to an interior face of second side frame 118. Interchangeable furniture section 160 includes a front rail 162, a deck covering 163, and first and second side frames 164,166. A second pair of strap assemblies 172, 174 are connected to an interior face of first side frame 164. A second pair of buckle assemblies 168, 170 are connected to an interior face of second side frame 166.

Figure 14:
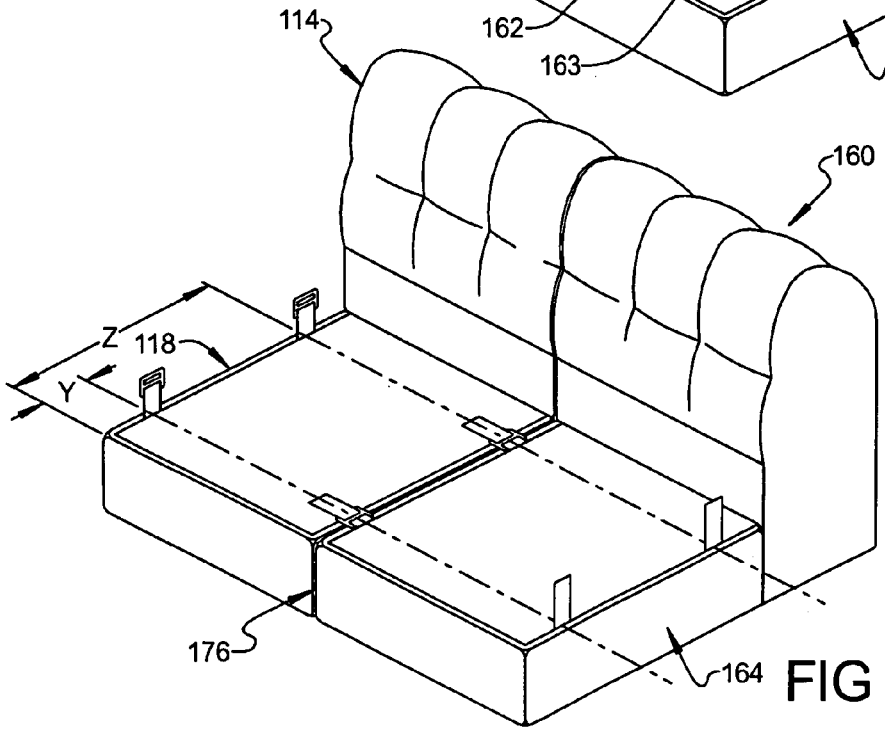
FIG. 14 is a front perspective view, showing an assembled condition of the two interchangeable furniture sections of FIG. 13.

As best seen in reference to FIG. 14, an abutting joint 176 is created between first side frame 116 and second side frame 166 when first strap assembly 150 is connected to buckle assembly 168 and when second strap assembly 152 is connected to buckle assembly 170. An alternate configuration is also possible by joining second side frame 118 to first side frame 164 by connecting strap assembly 172 to first buckle assembly 140, and connecting strap assembly 174 to second buckle assembly 142. To correctly pre-align the strap and buckle assemblies when the furniture sections are abutted, each strap assembly of one of the interchangeable furniture sections is positioned to align with a corresponding buckle assembly of another interchangeable furniture section. A spacing Y and a spacing Z are therefore maintained for the strap and buckle assemblies to pre-align the strap and buckle assemblies for interchangeability between any two interchangeable furniture sections. Spacing Y and spacing Z can differ between different types of furniture items such as between chairs and sofas based on differences in geometry, but are maintained for each section of a specific design of interchangeable furniture sections.

In this embodiment, by oppositely positioning strap assemblies from buckle assemblies at opposite sides of interchangeable furniture sections or at end sections, two strap connections of the present disclosure are provided at each side to join the furniture sections. The positions of the strap and buckle assemblies of FIGS. 10-12 are also hidden when the furniture sections are joined and any cushions are in place.

The exemplary positions shown for various strap assemblies using the attachment strap system 10 of the present disclosure are exemplary only. Any suitable location for attachment of the strap assemblies using a sewing technique is acceptable, at the discretion of the designer, even if the strap assemblies are visible after placement. Therefore, additional attachment locations such as furniture member legs, furniture member arms, furniture member back section areas, etc., can also be used. For maximum flexibility of use of the attachment strap system 10 of the present disclosure, pairs of the strap assemblies positioned as described herein are desirable, however, single or greater than two strap assemblies can also be used.

Modular furniture attachment straps of the present disclosure offers several advantages. By using generally flat strap material releasably joined using hook and loop connections, the attachment straps can be positioned beneath cushions or upholstery coverings so they are not visible when in use. The hook and loop attachment connections of the present disclosure provide a simplified alignment and releasable joining system for modular furniture sections. Alignment of individual sections does not require visual alignment of extending fasteners, potential damage to other sections, other furniture or walls from male extending mechanical connectors. Use of reverse configured straps of the present disclosure also allows any section of furniture to be connected to any other section without the use of threaded fasteners, the loss of fastener members and/or the addition of fasteners.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A furniture member strap connection system, comprising:

a first member including:

a first connecting region having a plurality of loop members;

a first sewn area positioned proximate to the first connecting region;

a second connecting region positioned proximate to the first sewn area and oppositely positioned from the first connecting region, the second connecting region having a plurality of hook members;

first, second, third, and fourth notches created in the first member, and a first seam sewn along a first seam line defined between the first and second notches, and a second seam sewn along a second seam line defined between the third and fourth notches, the first and second seams attaching the first and second connecting regions to the first member; and a second member including:

first and second sections overlapping each other and operable to create a looped end;

a buckle member having an elongated aperture operable to engage the looped end; and a second sewn area operable to connect the first and second sections and positionable where the first and second sections overlap each other; and an assembly having the first connecting region of the first member slidably disposed through the elongated aperture of the buckle member and the plurality of loop members releasably engaged with the plurality of hook members.

2. The system of claim 1, further comprising a pull tab connected to the first member proximate to the hook members and opposite to the loop members.

3. The system of claim 1, wherein the buckle member comprises a polymeric material.

4. The system of claim 1, wherein both the first and the second members comprise a woven cloth material.

5. The system of claim 4, wherein the woven cloth material further comprises at least a polymeric material.

6. The system of claim 1, further comprising:

a first material patch having the first member pre-sewn to the first material patch; and a second material patch having the second member pre-sewn to the second material patch;

wherein the first material patch is fixedly joined to the first member of the furniture member strap connection system and the second material patch is fixedly joined to the second member of the furniture member strap connection system.

7. A furniture member strap connection system, comprising:

a first strap having a plurality of loop members at a first end and a plurality of hook members at a second end and a first sewn area positioned between the loop members and the hook members;

a second strap having opposed ends overlapping each other and defining a looped end;

a buckle member having an elongated aperture receiving the looped end of the second strap;

a first furniture member having the first strap sewn to the first furniture member at the first sewn area;

a second furniture member having the second strap sewn to the second furniture member so that the buckle member is freely extending;

a first material patch having the first strap connected to the first material patch, and a second material patch having the second strap connected to the second material patch, each of the first and second material patches individually connected to a side frame of one of the first and second furniture members and each positioned proximate to a junction between the side frame and a deck covering of the furniture member;

first and second apertures pre-located in the first and second material patches operable to visually line up individual ones of the first and second straps for attachment to the individual ones of the first and second furniture members;

a first strap assembly having the second end of the first strap slidably disposed through the elongated aperture of the buckle member and the plurality of hook members releasably engaged with the plurality of loop members, the first strap assembly operable to releasably join the first and second furniture members.

8. The connection system of claim 7, further comprising a pull tab connectably joined to the first strap proximate to the hook members and opposite to the loop members, the pull tab adapted to be received within the elongated aperture when the first strap is slidably disposed through the elongated aperture of the buckle member.

9. The connection system of claim 8, further comprising a second strap assembly oppositely configured from the first strap assembly.

10. The connection system of claim 9, wherein the first and second strap assemblies span an abutting joint created between the first and second furniture members to releasably join the first and second furniture members.

11. The connection system of claim 7, further comprising:

a first end of the first furniture member having a first pair of the first straps fixed to the first end; and a second end of the first furniture member having a first pair of the second straps fixed to the second end;

a first end of the second furniture member releasably abutted with the second end of the first furniture member, the first end of the second furniture member having a second pair of the first straps alignable to engage the first pair of the second straps of the second end of the first furniture member.

12. The connection system of claim 11, further comprising a second end of the second furniture member releasably abutted to the first end of the first furniture member, the second end of the second furniture member having a second pair of the second straps alignable to engage the first pair of the first straps of the first end of the first furniture member.

13. A method for connecting furniture members using a strap assembly, the strap assembly including a first strap having a plurality of loop members at a first end and a plurality of hook members at a second end, and a first sewn area positioned between the loop members and the hook members; a second strap having opposed ends overlapping each other and defining a looped end; and a buckle member having an elongated aperture operable to receive the looped end, the method comprising:

creating opposed notches in both the first strap operable for aligning the plurality of hook members and the plurality of loop members;

attaching the first strap to a first furniture member at the first sewn area;

connecting the second strap to a second furniture member; slidably disposing the second end of the first strap through the elongated aperture of the buckle member;

releasably engaging the plurality of hook members with the plurality of loop members to releasably join the first and second furniture members; and pre-sewing the first strap to a first material patch after aligning the first strap with a first pair of apertures created on the first material patch;

pre-sewing the second strap to a second material patch after aligning the second strap with a second pair of apertures created on the second material patch; and fixedly joining opposing ones of the first and second material patches to individual ones of the first and second furniture members.

14. The method of claim 13, further comprising connecting a pull tab to a free portion of the second end.

15. The method of claim 14, further comprising pulling the pull tab in a first direction until the first and second furniture members abut each other prior to the engaging step.

16. The method of claim 15, further comprising pulling the pull tab in a second direction after the engaging step to disengage the plurality of hook members from the plurality of loop members.

* * * * *